US006766969B2

(12) United States Patent
Haltiner, Jr. et al.

(10) Patent No.: US 6,766,969 B2
(45) Date of Patent: Jul. 27, 2004

(54) INTEGRAL VALVE SEAT AND DIRECTOR FOR FUEL INJECTOR

(75) Inventors: Karl Jacob Haltiner, Jr., Fairport, NY (US); Robert B. Perry, Leicester, NY (US); Timothy P. Landschoot, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 415 days.

(21) Appl. No.: 09/945,122

(22) Filed: Aug. 30, 2001

(65) Prior Publication Data

US 2002/0030123 A1 Mar. 14, 2002

Related U.S. Application Data

(63) Continuation-in-part of application No. 09/660,950, filed on Sep. 13, 2000.

(51) Int. Cl.[7] ..... B05B 1/00

(52) U.S. Cl. ..... 239/596; 239/533.12; 239/533.14; 239/585.1; 239/585.3; 239/585.4

(58) Field of Search ..... 239/533.12, 533.14, 239/585.1, 585.3, 585.4, 596; 29/890.142

(56) References Cited

U.S. PATENT DOCUMENTS 4,813,610 A * 3/1989 Renowden ..... 239/499
5,979,866 A * 11/1999 Baxter et al. ..... 251/129.21

FOREIGN PATENT DOCUMENTS

GB 2144177 A * 2/1985 ..... F02M/51/08

* cited by examiner

*Primary Examiner*—Robin O. Evans
(74) *Attorney, Agent, or Firm*—Patrick M. Griffin

(57) ABSTRACT

A valve seat/director unit the combines the functions of an injector valve seat and a separate spray director plate into an integral unit combining both functions. The unit is a generally flat plate having an outer portion with at least one sealing rib. A central portion includes at least one endless rib forming a valve seat and surrounding a spray director including a recessed area communicating with at least one fuel spray opening. Upper surfaces of the sealing rib(s) and valve seat are preferably flat and coplanar with one another for engagement by cooperating surfaces of an injector member and a valve member, respectively.

8 Claims, 4 Drawing Sheets

INTEGRAL VALVE SEAT AND DIRECTOR FOR FUEL INJECTOR

CROSS REFERENCE TO RELATED APPLICATIONS

This application is a continuation-in-part of copending U.S. patent application Ser. No. 09/660,950, filed Sep. 13, 2000. Certain subject matter disclosed in that parent application is claimed in U.S. patent application Ser. No. 09/660,952 filed concurrently on Sep. 13, 2000.

TECHNICAL FIELD

This invention relates to solenoid actuated fuel injectors for engines and, more particularly, to an injection valve seat/director formed as an integral dual function unit.

BACKGROUND OF THE INVENTION

It is known in the art relating to solenoid actuated engine fuel injectors to provide a valve seat for engagement by a disk-like armature to cut off fuel flow through an injector. A separate fuel spray director may be provided with spray holes to direct an atomized spray of fuel from the valve seat into an engine. Typically, the valve seat and the spray director are separate components requiring individual forming and machining or other processing and requiring assembly in an injector with other components to form a completed structure ready for use. A simpler valve seat and spray director assembly involving less costly or reduced processing steps is desired.

SUMMARY OF THE INVENTION

The present invention provides an improved and simplified valve seat/director unit, which combines in an integral unit the functions of a valve seat and a fuel spray director. The unit is preferably made using electroforming and/or metal etching processes. The unit may be made in layers with the same or differing materials, if desired, and with differing thickness to best accomplish the purposes of the integral unit.

In an optional embodiment, a valve seat/director unit is formed as an integral multiple thickness unit for an engine fuel injector. The unit is essentially a flat plate with an outer portion including a rim or plurality of raised ribs, which are engagable with a spacer rim or other member of an injector for forming an external seal. A central portion includes a plurality of spray holes or openings surrounded on at least one side by a raised rib forming a valve seat. The seat may be varied in configuration for engagement by a solenoid valve disk or a plunger type valve as desired. The valve seat and the outer rim or ribs are preferably formed as coplanar surfaces with equal thickness through the plate. Intermediate portions of an upper surface are recessed to allow fuel flow to the valve seat but may include raised shapes for engaging a mating member.

The seat/director may be formed as an integral unit in any suitable manner. However, electroforming, metal etching or a combination of both are presently preferred methods. By these methods, a dual thickness valve seat/director unit may be formed by simple processing to finished dimensions without requiring further finishing steps. A simplified, cost efficient unit is thus provided, combining the features of separate valve seats and director plates while avoiding the machining or forming and assembly steps these separate components require.

These and other features and advantages of the invention will be more fully understood from the following description of certain specific embodiments of the invention taken together with the accompanying drawings.

DESCRIPTION OF THE PREFERRED EMBODIMENT

Figure 1:
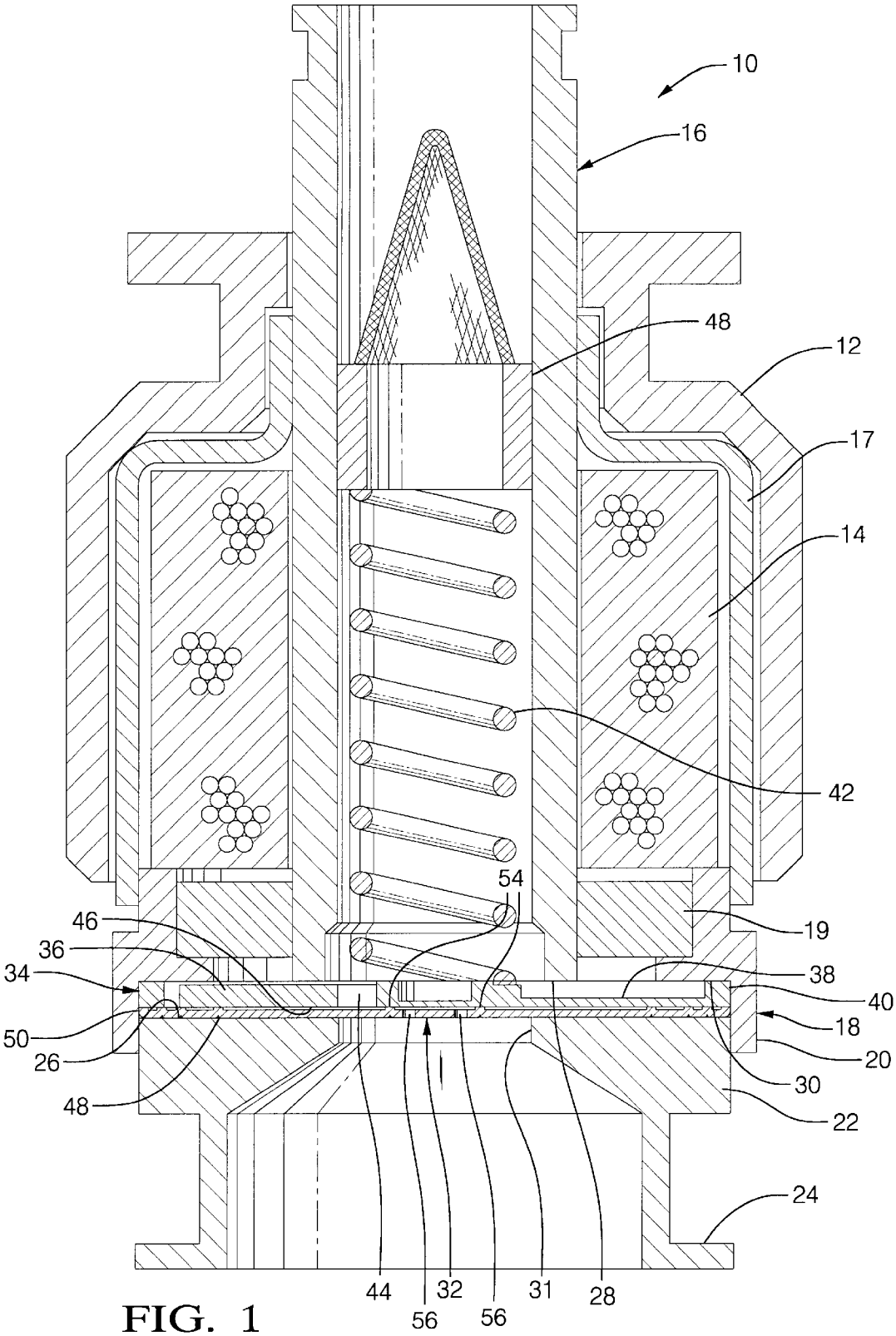
FIG. 1 is a cross-sectional view of an exemplary solenoid actuated fuel injector having an integral valve seat/director unit according to the invention.
Figure 2:
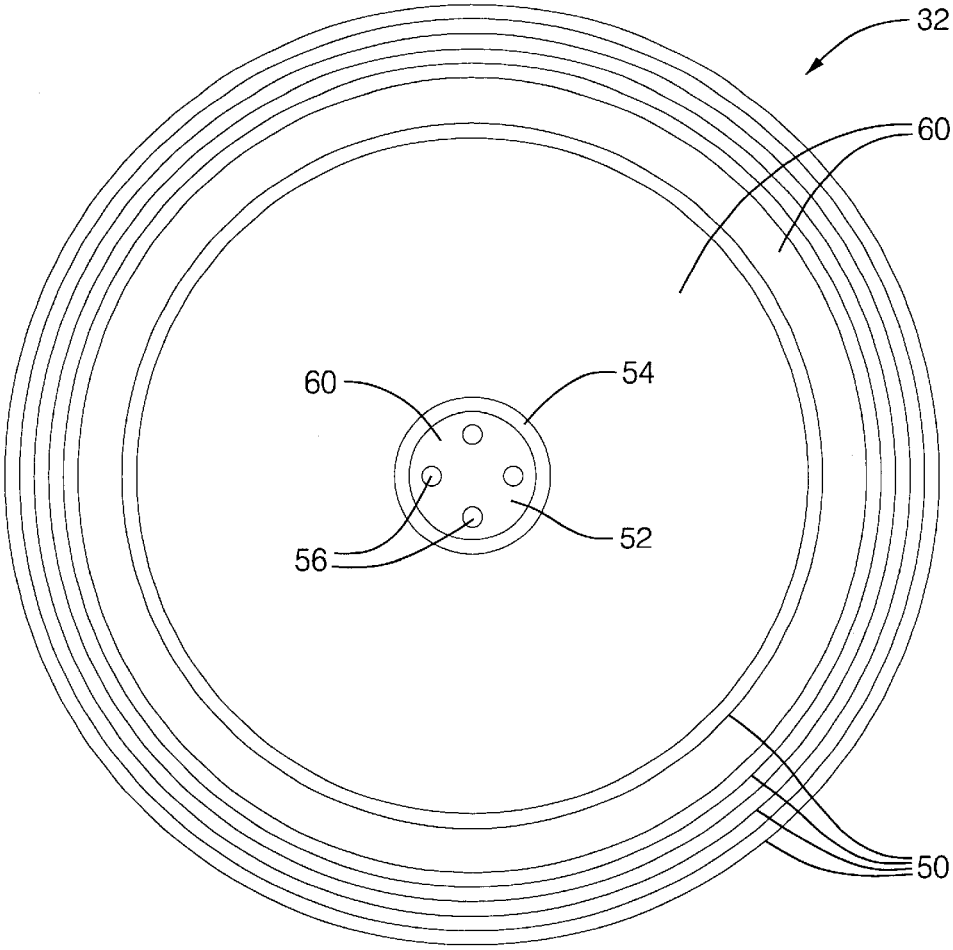
FIG. 2 is an enlarged top view of the integral unit of FIG. 1.
Figure 3:
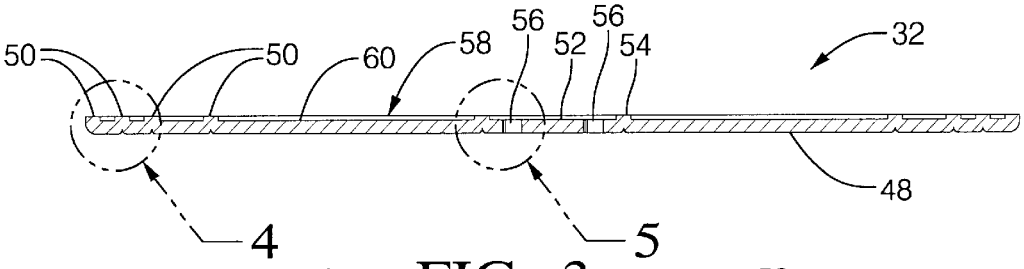
FIG. 3 is a cross-sectional view from the line 3—3 of FIG. 2.
Figure 4:
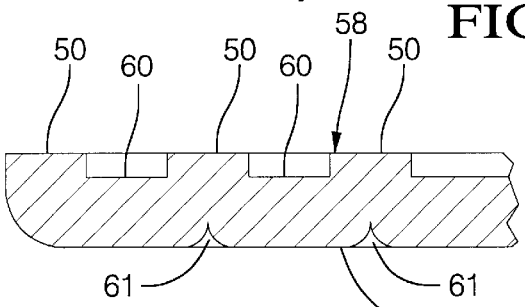
FIG. 4 is an enlarged view of the portion in circle 4 of FIG. 3.
Figure 5:
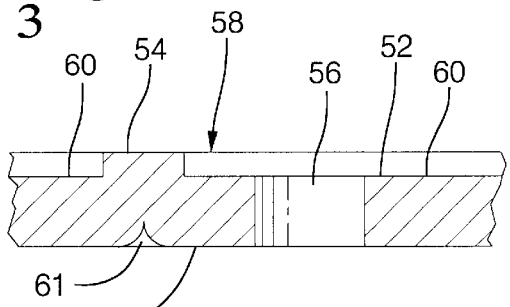
FIG. 5 is an enlarged view of the portion in circle 5 of FIG. 3.

Referring first to FIG. 1 of the drawings in detail, numeral 10 generally indicates an exemplary solenoid actuated fuel injector for an engine. Injector 10 includes a non-magnetic cover 12 enclosing a solenoid coil 14. A fuel tube extends through the coil and acts as an inner magnetic pole 16. An outer strap 17 connects with the inner pole 16, extends around the coil 14 and connects with an annular member forming an outer magnetic pole 18. A nonmagnetic spacer 19 provides a seal between the inner and outer poles below the coil.

The outer pole 18 includes a skirt 20 that is fixed to a lower housing 22 defining an external seal groove 24. Housing 22 has a flat upper wall 26 that opposes and is spaced from coplanar flat lower surfaces 28, 30 of the inner and outer poles, respectively. The housing 22 also has a central opening 31 through the upper wall 26 and connecting with an enlarged open area below for the passage of fuel spray from the injector.

Disposed between the housing upper wall 26 and the magnetic pole lower surfaces 28, 30 is an injection valve comprising a valve seat and spray director unit 32 formed according to the invention, and an armature/spacer member 34.

The armature/spacer member 34 includes a movable armature 36 connected by flexible legs 38 to an outer rim 40. A spring 42 biases the armature against the seat/director unit 32 to cut off fuel flow through the injector. Armature 36 also includes fuel openings 44 through a center portion near the spring 42. A lower surface 46 of the member 34 remains flat when the armature is seated in the closed position on the seat/director unit 32.

Referring now to FIGS. 1–5, seat/director unit 32 is made as an integral body and is shaped as a circular disk, which includes a flat lower surface 48, that seats against the flat upper wall 26 of the lower housing 22. A thickened outer rim or concentric outer ribs 50 form a periphery of the disk while one or more raised ribs in a central portion 52 of the disk form a valve seat 54. Spray holes 56 within the central portion form a director plate to atomize a spray of fuel passing through the holes 56. The rim or outer ribs 50 and the valve seat 54 preferably have equal thickness dimensions and so define a flat upper surface 58 of the seat/director unit 32. Within the valve seat 54, between the outer ribs 50 and intermediate the valve seat and outer ribs, the upper portion of unit 32 is recessed, preferably defining coplanar recessed surfaces 60.

The disk for the seat/director unit 32 is preferably made very thin to adapt it for cost efficient manufacture by processes such as electroforming, optionally combined with metal etching. In particular, the seat/director unit 32 is made substantially thinner than the disk armature 36 of the embodiment of FIG. 1. Electroforming processes are able to provide flat sealing surfaces and accurate orifice dimensions without machining. They also use only small amounts of metal as compared to machined components which are inherently heavier.

In operation of the injector in an engine, pressurized fuel is admitted to the fuel tube/inner pole 16 and flows through armature fuel openings 44 to the recessed intermediate surface 60 of the valve seat/director unit 32, where it is blocked while the armature 60 remains seated against the valve seat 54. When the solenoid coil 14 is energized, armature 36 is drawn upward against the magnetic poles 16, 18. This opens the valve seat 54, allowing the fuel to flow through the spray holes 56 of the integral director plate portion of unit 32. Fuel flow continues until the coil 14 is de-energized and the spring 58 again forces the armature 36 to engage the valve seat 54.

The seat/director unit 32 of FIGS. 2–5 may be made by any suitable process. However, the figures show an embodiment made by a preferred method of electroforming. In this method, a mandrel is machined with a surface that forms a mold for the upper side of the unit 32 to be formed inverted on the mandrel. A suitable metal valve seat material is then formed on the mandrel by the known process of electroforming. The material fills in grooves in the mandrel to form the ribs 50 and valve seat 54 of the unit 32. A resist applied to the mandrel at the spray hole locations prevents metal deposition there and thus accurately forms the spray holes 56. The metal deposition on the mandrel surfaces is very even and precise, so that flat lower surface 48 of the unit 32 does not need further finishing steps. The upper surfaces are accurately molded to the desired shape by the initial shape of the mandrel. Opposite the locations of the ribs and valve seat 50, 54, the lower surface 48 of the unit 32 is recessed at 61 as a result of the even deposition process. These recesses 61 have no function and are merely a result of the forming process.

Other methods of forming integral seat/director units could also be used as desired. For example, the multi-thickness unit could be electroformed in layers by using resists to form the raised portions after a flat lower portion is first formed. Alternatively, an electroformed disk could be further shaped by metal etching. Any other suitable method may also be used.

Figure 6:
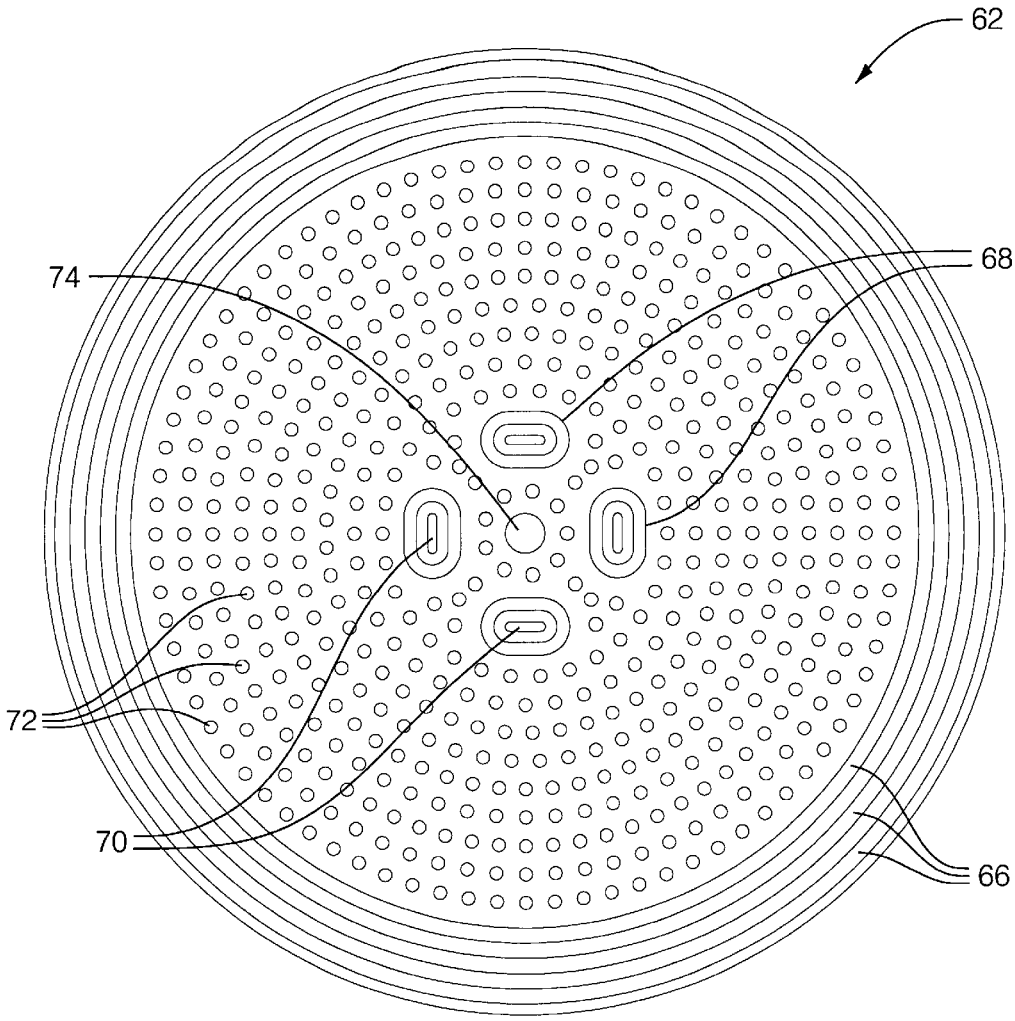
FIG. 6 is a top view of an alternative embodiment of valve seat/director unit.
Figure 7:
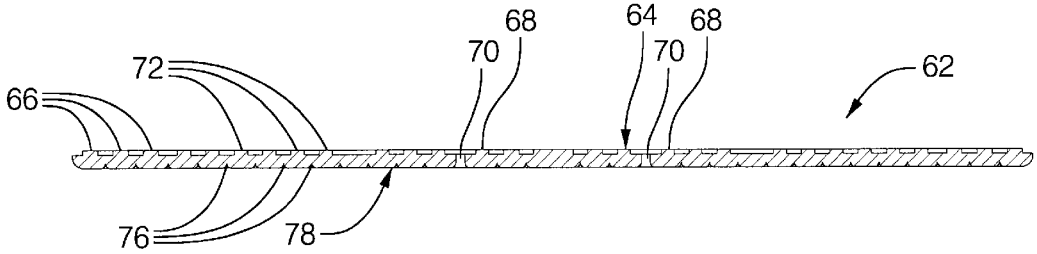
FIG. 7 is a cross-sectional view from the line 7—7 of FIG. 6.

FIGS. 6 and 7 illustrate a modified seat/director unit 62 exemplary of alternative embodiments according to the invention. Unit 62 is a generally flat disk formed by electroforming as before. Its upper surface 64 includes outer ribs 66 and four separate oval shaped valve seats 68 surrounding annularly spaced elongated spray holes 70. A recessed area surrounding the valve seats 68 and extending to the outer ribs 66 contains many spaced small raised portions 72 and a larger raised center 74. These provide additional surfaces engagable by a valve disc, plunger, or other member of a suitable injector configuration. The spaced valve seats 68 allow fuel to enter the spray holes 70 from all sides of the holes when a cooperating valve member is moved away from the seats 68. Again, the electroforming method may leave non-functional recesses 76 on the lower surface 78 of the unit 62.

Figure 8:
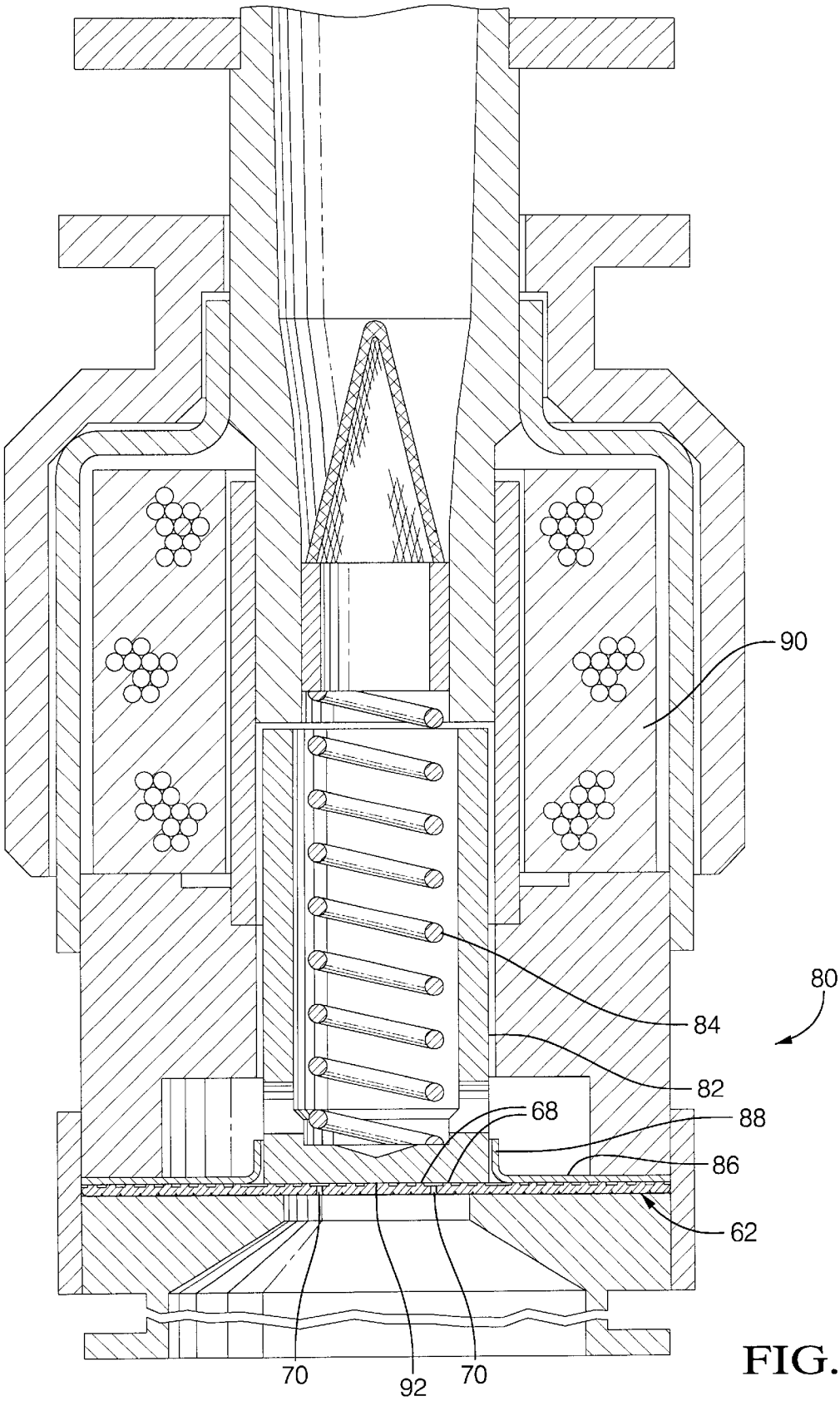
FIG. 8 is a view similar to FIG. 1 but showing a plunger type injector incorporating a valve seat/director unit according to the invention.

FIG. 8 shows a plunger type fuel injector 80 in which the seat/director units 32 and 62 could be utilized instead of in the disk type injector 10 of FIG. 1. Injector 80 includes a reciprocable valve plunger 82 biased by a spring 84 against the valve seats 68 of a seat/director unit 62, for example (see FIGS. 6 and 7). A lower plunger guide 86 is seated on outer portions of the unit 62. A central hub 88 of the guide 86 extends up around the lower end of the plunger 82 to guide its motion.

Energizing of a solenoid coil 90 unseats the plunger 82, allowing fuel to flow under the plunger and through the spray holes 70 as an atomized spray. The small raised portions 72 of the outer portion of unit 62 engage and support inner portions of the disk 86. Portions 72 on the inner portion of the disk and the larger center portion 74 are engaged by the closed end 92 of the plunger 82 to limit its force on the seats 68 in the central portion of the unit 62. The remaining features of injector 80 are sufficiently similar in structure and operation to injector 10 as not to require further description for a full understanding of the invention.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An injection valve seat/director formed as an integral multiple function multiple thickness unit for an engine fuel injector, said unit adapted for manufacture by electroforming processes and comprising:

a generally circular thin disk having a generally flat lower surface and an upper surface including an outer portion, a central portion and an intermediate portion;

the outer portion including at least one raised annular rib having a flat upper surface for engaging a cooperating injector surface;

the central portion including at least one endless rib having a flat upper surface forming a valve seat engagable by a movable valve member of an injector, said valve seat surrounding a recessed spray director portion including a plurality of fuel spray openings through the seat/director unit; and said intermediate portion including a recessed area extending around the valve seat for receiving pressurized fuel for delivery to the fuel spray openings upon unseating of the valve member from the valve seat;

wherein the electroformed disk is formed accurately without machining and is made thin to minimize the mass of metal and the cost of the electroforming process.

2. The invention of claim 1 wherein the seat/director unit has a thickness less than that of a disk valve member associated with said unit.

3. The invention of claim 1 wherein said valve seat comprises a circular rib surrounding a plurality of fuel spray openings.

4. The invention of claim 1 wherein said valve seat comprises a plurality of endless ribs spaced within the central portion, each rib surrounding at least one fuel spray opening.

5. The invention of claim 1 wherein said intermediate portion includes a plurality of raised portions spaced within the recessed area, said raised portions having flat upper surfaces for engagement with an associated member of an injector.

6. The invention of claim 1 wherein said flat upper surfaces of the outer and central portions are coplanar.

7. The invention of claim 1 wherein said unit is formed by electroforming.

8. The invention of claim 1 wherein said unit is formed by a combination of electroforming and metal etching.

* * * * *